United States Patent [19]

Augustin

[11] 4,064,856

[45] Dec. 27, 1977

[54] CONTROL MECHANISM FOR INJECTION PUMP

[75] Inventor: Ulrich Augustin, Stuttgart, Germany

[73] Assignee: Daimler-Benz Aktiengesellschaft, Germany

[21] Appl. No.: 706,296

[22] Filed: July 19, 1976

Related U.S. Application Data

[63] Continuation of Ser. No. 469,451, May 13, 1974, abandoned.

[30] Foreign Application Priority Data

May 15, 1973 Germany ..... 2324419
May 15, 1974 Germany ..... 2401727

[51] Int. Cl.[2] ..... F02M 39/00
[52] U.S. Cl. ..... 123/140 R; 123/140 CC
[58] Field of Search ..... 123/140 R, 140 MC, 140 CC

[56] References Cited

U.S. PATENT DOCUMENTS

| | | | |
|---|---|---|---|
| 2,782,769 | 2/1957 | Best | 123/140 CC |
| 3,015,326 | 1/1962 | Wirsching et al. | 123/140 CC |
| 3,146,770 | 9/1964 | Garcea | 123/140 CC |
| 3,727,598 | 4/1973 | Knapp | 123/140 R X |
| 3,814,072 | 6/1974 | Gillespie | 123/140 MC X |

FOREIGN PATENT DOCUMENTS

| | | | |
|---|---|---|---|
| 811,904 | 4/1959 | United Kingdom | 123/140 CC |

*Primary Examiner*—Ronald H. Lazarus
*Assistant Examiner*—Tony M. Argenbright
*Attorney, Agent, or Firm*—Craig & Antonelli

[57] ABSTRACT

A control mechanism for an injection pump for internal combustion engines, espcially for Diesel engines, which includes an axially displaceable control rod changing the injection quantity by axial displacement and an adjusting lever for the control rod which is pivotally connected with the latter and is in operative engagement with a fuel quantity lever actuatable at will to adjust the engine power; a further point of pivotal connection of the adjusting lever is displaceable by a first cam surface as a function of the rotational speed of the engine to provide a partial load control while a maximum abutment adjustment for the control rod which provides a full load limitation on the basis of contacting a second cam surface, is also actuated as a function of the rotational speed.

86 Claims, 6 Drawing Figures

CONTROL MECHANISM FOR INJECTION PUMP

This is a continuation, of application Ser. No. 469,451 filed May 13, 1974 now abandoned.

The present invention relates to a control mechanism for an injection pump for internal combustion engines, especially for Diesel engines, with an axially displaceable control rod or rack varying the injection quantity of the pump by axial displacement, with an adjusting lever for the control rod which is pivotally connected with the control rod and is in pivotal connection at least indirectly with the fuel quantity lever adjusting the fuel quantity, whereby a further point of pivotal connection of the adjusting lever is displaceable in dependence on the engine rotational speed within the partial load range, at least within partial ranges of the rotational speed range, at least indirectly, by the shifting sleeve of a centrifugal governor (partial load control) and with a maximum abutment adjustment for the control rod effected at least indirectly also by the shifting sleeve on the basis of a sensing of or contact with a cam surface actuated in dependence on the rotational speed (full load limit).

Different influences and/or requirements, for example, the maintenance of the smoke limit within the entire rotational speed range, the desired curve of the full load torque over the rotational speed, a change of the actual injection quantity over the rotational speed with a constant control rod position and a change of the suction air volume with a rotational speed increase, make appear desirable a very predetermined progress or variation of the full load- and partial load control rod position as a function of the rotational speed, which is not quite simple.

One has attempted heretofore to realize approximately such a desired progress or course of the full load control rod position by a suitable combination of spring of different stiffness or hardness in the centrifugal governor. However, only quite an incomplete approximation to the actually required course is possible by this approach.

The present invention starts with another hitherto unpublished proposal in connection with so-called variable speed governors, i.e., in connection with control mechanisms which are used primarily in engines for construction and agricultural machines and for tools, and which within a relatively small rotational speed interval, predetermined by the injection quantity-pedal position in its rotational speed level, steeply control the injection quantity, i.e., maintain at least approximately a predetermined rotational speed. According to this prior, unpublished proposal, the adjustment of the control rod is varied as desired at full load over the range of the rotational speed by a cam or template displaced by the shifting sleeve of the centrifugal governor and shaped corresponding to the desired course of the full load injection quantity. However, this proposal cannot be transferred without significant changes to the so-called filling or fuel injection control mechanisms or regulators which are used principally in motor vehicle Diesel engines since with these control mechanisms, the injection quantity is set and predetermined exclusively by the pedtal position within the normal rotational speed range of the engine and a change of the sliding sleeve position does not take place in the normal rotational speed range.

It is the aim of the present invention to provide a control mechanism construction which permits to use a full load limitation by means of a template actuated in dependence on the rotational speed also with filling or fuel injection control mechanisms or regulators. The underlying problems are solved according to the present invention in that with the aforementioned control mechanism, a cam surface indirectly sensed or contacted by the further point of pivotal connection of the adjusting lever is provided in the train or connection of the actuating force between the sliding sleeve and the further point of pivotal connection of the adjusting lever which cam surface is displaceable or pivotal at least indirectly by the shifting sleeve.

Owing to the interconnection in accordance with the present invention of a cam surface which becomes effective in the manner of a template, for influencing the movement also in the force connection for the partial load control, a standstill or halting of the control elements sensing or contacting the cam surface is able to take place by reason of a suitable construction of the cam surface, notwithstanding a displacement of the sliding sleeve and of the cam surface. Additionally, also complicated mathematical interrelationships and functional relationships can be realized by a suitably shaped cam surface configuration and thus the control linkage can be considerably simplified from a constructive point of view.

The control of the injection quantity below the idling rotational speed can be realized in that the partial load cam surface is provided at that place, which during engine standstill comes in contact with the cam follower or contact roller or the like, with a recess or depression in such a manner that the control rod is displaced to a position corresponding to an injection quantity suitably large for engine starting purposes, and in that the partial load cam adjoining the depression has a rising or ascending flank within the movement area of the partial load cam corresponding to the rotational speed interval between zero and idling rotational speed in such a manner that the control rod or rack is pulled back or retracted within this rotational speed interval by a displacement path corresponding to the reduction control from the starting injection quantity to the idling injection quantity.

A filling or fuel injection control mechanism can be realized in one embodiment of the present invention in that the partial load cam surface has at least an approximately constant raised cam portion adjoining the rising flank over a movement range corresponding to the entire operating rotational speed range and within the movement range of the cam surface corresponding to the maximum range includes again a rising cam flank effecting a control rod displacement in the sense of an injection quantity reduction (filling or fuel injection control cam). Owing to the range of a constant raised cam portion, i.e., a cam portion of constant level extending over the normal rotational speed range, it is possible to obtain a standstill or halt of the further point of pivotal connection of the adjusting lever which is necessary for the control behavior of the filling or fuel injection control mechanism, notwithstanding a movement of the cam surface necessary for the displacement of the full load limit cam.

A variable speed regulator can be realized in that the partial load cam surface, adjoining the rising flank, has an at least approximately constantly rising configuration (variable speed governor cam) over a movement range corresponding to the entire rotational speed range and in that the transmission ratio of the actuating linkage disposed between the cam roller following the partial load cam surface and the control rod is so selected that during the movement of the partial load cam to an extent of only a small fraction of the entire displacement range thereof, the control rod is displaced by at least approximately the full control rod stroke or travel.

It is particularly advantageous if the cam surface for the partial load control and the cam surface for the full load limitation are provided at a common element displaced by the shifting sleeve since a further constructive simplification can be achieved therewith.

In addition to the solution of the problems underlying the present invention, a number of other very desirable advantages are achieved by the present invention. These reside, on the other hand, in that, by reason of the cam influence on the control behavior both in the full load range as also in the partial load range, the necessary control characteristics no longer need to be established by very complicated actuating kinematics having a sliding template or the like. These linkages are not only expensive in their manufacture but include a large number of joints connected with play. By reason of the special joint construction the play was in part even very great. This play could be eliminated in its effect by a play-compensating-spring, however, only in those operating conditions in which the mass forces of the actuated masses of the control mechanism and of the injection pump were negligibly small compared to the force of the compensating spring. During very rapid control actions, this, however, was not the case and the play present in the joint of the control linkage became a factor that had to be taken into consideration and became effective very disadvantageously on the behavior of the control mechanism. It is true that an actuating linkage also cannot be dispensed with altogether in the control principle according to the present invention. However, the linkage necessary therefor includes in practice only simple bolt joints which by reason of their simplicity are inexpensive in manufacture and can be realized with relatively small play. The control linkage is thereby less complicated and includes fewer and more simple joint places which also exhibit less clearance or play. As a result thereof, the control linkage according to the present invention is less expensive in manufacture. Additionally, the overall play is considerably smaller. Since furthermore the mass of the control linkage is smaller and the deflections of the parts displaced during a control operation are smaller in comparison with the prior art control mechanisms, the velocities at which the mass forces of the control linkage are no longer negligible in comparison to the force of a compensating spring, are also considerably higher in comparison to the prior art regulators or control mechanisms; this means, the dynamic behavior of the regulator or control mechanism constructed according to the present invention is more favorable in comparison to the prior art constructions. Also, the smaller friction of the displaced parts as compared to the prior art constructions contributes thereto. Additionally, two different basic principles of regulators or control mechanisms and all intermediate steps are realizable by means of one and the same control linkage merely by the exchange of a cam disk. Consequently, the present invention also contributes to model simplification in the manufacture of the regulator or control mechanism whereby the manufacture thereof can be still further reduced in cost.

Even though the measures described so far provide a considerable improvement as regards the freedom from play and low mass of the control linkage as compared to prior art regulators or control mechanisms, still further improvements can be attained according to the present invention in this regard. More particularly, the number of points of pivotal connection can be varied in that a lever (full load lever) equipped with a cam-follower roller or the like, cooperating with the full-load limit cam surface and movably supported in the direction of the raised portions of this cam surface and in the direction of the control rod stroke with one degree of freedom, is provided in the regulator or control mechanism according to the present invention which is positively coupled or connected exclusively with the control rod, and in that the adjusting lever, also equipped with a cam-follower roller or the like, cooperating with the partial-load control cam surface and movably supported in the direction of the control rod stroke and in the direction of the raised portion of the partial load control cam surface with one degree of freedom and movably supported, preferably rotationally and locally movably supported, in the actuating direction of the adjusting linkage with a further degree of freedom, is operatively connected or coupled both with the control rod as also with the adjusting linkage, whereby the cam-follower roller or the like, the point of pivotal connection of the adjusting linkage and the point of pivotal connection with the control rod are arranged at different places of the adjusting lever.

Consequently, two levers are provided in the regulator or control mechanism, of which one is effective in the partial load range and of which the other is effective at full load and abuts with its cam-follower roller at the corresponding cam surface. The one lever (full load lever) has only one degree of freedom of movement and for that reason, it produces an unequivocal coordination of pump rotational speed to maximum control rod position. The other lever (adjusting lever) acting on the control rod has two degrees of freedom of movement and for that reason, the coordination of rotational speed and control rod position is not unequivocal but depends additionally also from the position of the adjusting linkage which is also pivotally connected and is actuatable at will. Owing to the two degrees of freedom of the adjusting lever of the control mechanism or regulator, it is possible to exert simultaneously a rotational speed dependent influence and a selective influence, at will, on the control rod adjustment within the partial load range.

It will be self-evident to the average person skilled in the art in the realization of the teachings according to the present invention that certain functions and movement possibilities of the regulator or control mechanism have to be taken into consideration. In particular, to be considered and to be matched to one another as regards the movement progress of the control linkage are:

The movement direction of the sliding sleeve of the centrifugal governor with a rotational speed increase;

the movement direction of the adjusting linkage with a power output increase; and the movement direction of the control rod with an injection quantity increase. p The movements initiated at the control rod or rack by a sliding sleeve movement or by an adjusting linkage movement have to be correct as regards the movement direction. Furthermore, in the realization according to the present invention, a mutual blocking of cams and of the two cam surfaces has to be avoided, i.e., the two cam levers must move without impairment in every desired position of the cam disk or disks and must be able to be moved with the cam-follower roller against the associated cam surface.

It is advantageous as regards the customary parallel position of control rod and axis of rotation of the centrifugal governor of the known injection pumps and as regards the possibility and the aim to construct the control linkage as so-called plane transmission, not only to arrange--as already suggested hereinabove--both the partial-load control cam surface as also the full load limiting cam surface at a common cam actuated by the sliding sleeve of the centrifugal governor, but above all to rotatably support these cams about an axis extending perpendicularly to the control rod or rack and to provide the raised cam portions to extend radially with respect to the axis of rotation.

In order to obtain as small as possible a feedback of one influence, for example, of the automatic rotational speed-dependent adjusting movement induced by the partial load cam surface on the adjusting lever, onto the other influence, for example, on the selectively actuatable adjusting linkage adjustable at will or vice versa, and in order to obtain as simple as possible a regulator or control mechanism, it is recommended according to the present invention to arrange the points of coupling connection at the adjusting lever and the center point of the cam-follower roller or the like on at least an approximately straight line.

With the customarily encountered movement directions of the control rod stroke and of the sliding sleeve stroke, in case of a rotational speed increase, it is kinematically correct with the simplest lever arrangement if the point of pivotal or coupling connection of the adjusting linkage at the adjusting lever is arranged between the point of pivotal connection for the control rod and the center point of the cam-follower roller or the like.

In order to be able to permit also steep cam flanks on the cam surface without the danger that non-permissive or unacceptable feedbacks are exerted by the cam surface on the cam-follower roller or the like, it is advantageous to so select the relative position of control rod, partial load cam surface and adjusting lever that during the operationally conditioned movements of the adjusting lever, the cam-follower roller moves at least approximately perpendicularly to the movement direction of the cam surface.

In order to ensure a completely satisfactory form-locking connection between the cam surface and the cam-follower roller in one direction of force transmission and in order to enable, on the other hand, at full load a lifting-off of the cam-follower roller of the adjusting lever from the partial load cam surface, it is appropriate that a spring pressing the cam-follower roller or the like against the cam surface, acts on the adjusting lever. In order to be able to use simultaneously this spring for an automatic control rod return in the direction of "idling" in case of a failure of or breakage in the adjusting linkage and thus to economize a separate spring to be provided for this emergency as well as the corresponding spring suspension, the point of engagement of the spring may be arranged both between the point of coupling connection for the adjusting linkage and the cam-follower roller or the like as also between the point of coupling connection for the control linkage and the point of coupling connection for the cam-follower roller or the like.

For the far-reaching elimination of non-linearities of the movement transmission from the cam surfaces to the control rod, the present invention recommends to arrange both the full load lever as also the adjusting lever, at least with respect to the effective lever portion thereof which is operatively connected or coupled to the control rod, at least approximately parallel to one another and at right angle to the control rod.

For purposes of reducing the number of levers, rocker or swinging levers and coupling members in the control linkage and correspondingly for the elimination of avoidable places of play at the points of mutual coupling or pivotal connections and further for purposes of reducing the mass of the moved or actuated parts of the control linkage—both has as a consequence an improvement of the dynamic behavior of the control mechanism or regulator —and, last but not least, for the constructive and manufacturing simplification of the control mechanism or regulator, it is advantageous if the adjusting lever is coupled or operatively connected with the control rod by way of at least one intermediate member arranged at least approximately coaxially to the control rod, if the effective length of the adjusting lever between the point of coupling connection and cam-follower roller or the like corresponds approximately to the perpendicular distance between the axis of the control rod and the axis of rotation of the cam disk, if the point of coupling connection of the adjusting lever at the intermediate lever is guided along a circular arc by way of a rocker arm or pivot lever which extends essentially parallel to the adjusting lever, points generally in the direction of the adjusting lever and is pivotally supported at a fixed bearing support, whereby the fixed point of pivotal connection of the control rod has a greater distance than the center point of pivotal connection of the cam disk, and if the rocker arm or pivot lever serves simultaneously as full load lever in that a cam-follower roller or the like if provided at a bell crank facing the cam disk and arranged at the rocker arm or pivot lever, which cam-follower roller is adapted to cooperate with the full load limit cam surface arranged at the cam disk disposed opposite thereto.

Another appropriate construction of the regulator or control mechanism in accordance with the present invention which also satisfies the aforementioned aims and objects, resides in that the full load lever is guided with the cam-follower roller radially to the full load cam surface parallel to itself, preferably by the control rod itself, and in that the adjusting lever is pivotally connected at a part rigidly connected with the control rod or rack or at the latter itself.

Accordingly, it is an object of the present invention to provide a control mechanism for an injection pump which avoids by simple means the aforementioned shortcomings and drawbacks encountered in the prior art.

Another object of the present invention resides in a control mechanism for fuel injection pumps in which a far-reaching approximation to the desired control course and to the actually occurring control progress is possible by simple means.

A further object of the present invention resides in a control mechanism for fuel injection pumps in which a full load limitation is possible by means of a cam or template actuated as a function of rotational speed also in connection with so-called filling or fuel injection control mechanisms.

Still a further object of the present invention resides in a control mechanism for injection pumps in which complicated functional interdependencies and mathematical interrelationships can be properly taken into consideration yet complicated and expensive constructions are avoided.

Still another object of the present invention resides in a control mechanism for injection pumps in which the required control characteristics can be realized both in the full load range as well as in the partial load range without complicated actuating kinematics.

Another object of the present invention resides in a control mechanism of the type described above which is extraordinarily simple in construction, inexpensive in manufacture and avoids a large number of parts and pivotal connections which unduly increase the overall play which occurs in the actuating mechanism.

Still a further object of the present invention resides in a control mechanism for injection pumps in which a relatively fast control action is assured under all operating conditions, even at velocities at which the mass forces of the control linkage are no longer negligible.

A further object of the present invention resides in a control mechanism of the type described above which excels by an improved dynamic behavior and permits a substantially identical basic construction for different types of engines or models, with which the control mechanisms are to be eventually used.

Still a further object of the present invention resides in a control mechanism for injection pumps in which a blocking interaction of the various control functions is effectively precluded.

These and other objects, features and advantages of the present invention will become more apparent from the following description when taken in connection with the accompanying drawing which shows, for purposes of illustration only, several embodiments in accordance with the present invention, and wherein.

Figure 3:
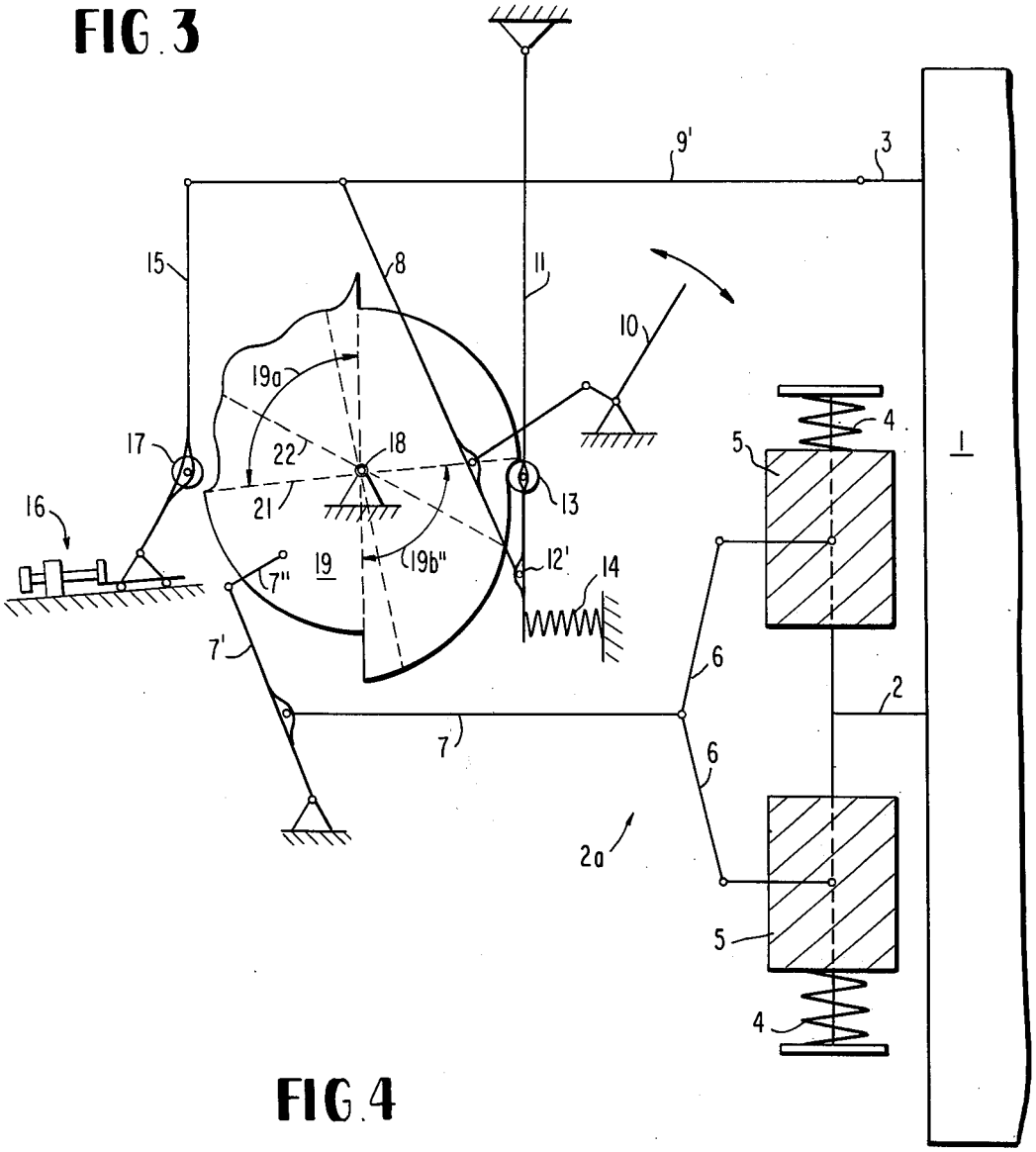
FIG. 3 is a schematic view of a modified embodiment of a variable speed control mechanism in accordance with the present invention.
Figure 4:
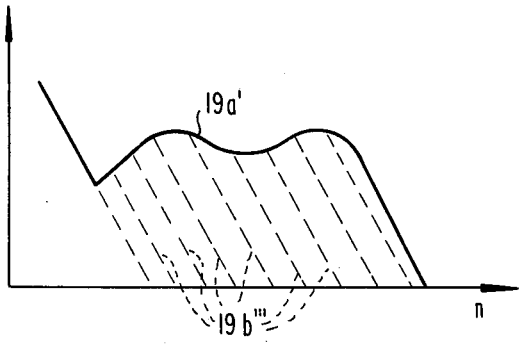
Figure 5:
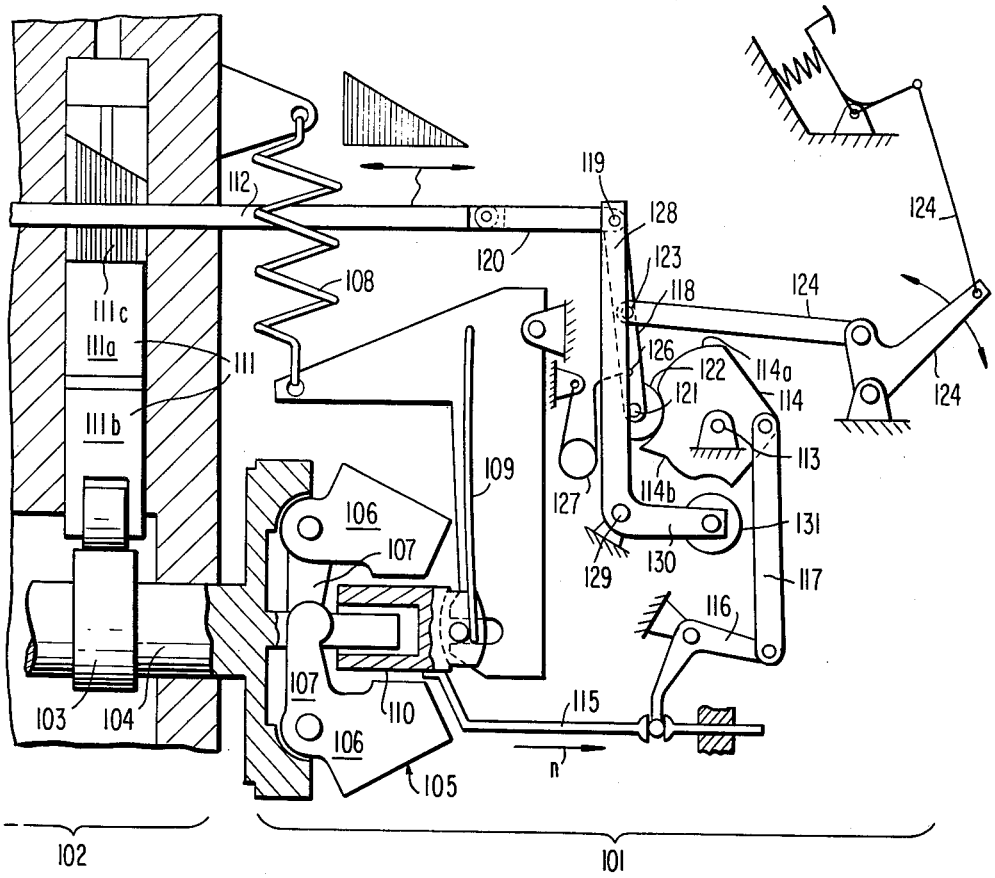
Figure 6:
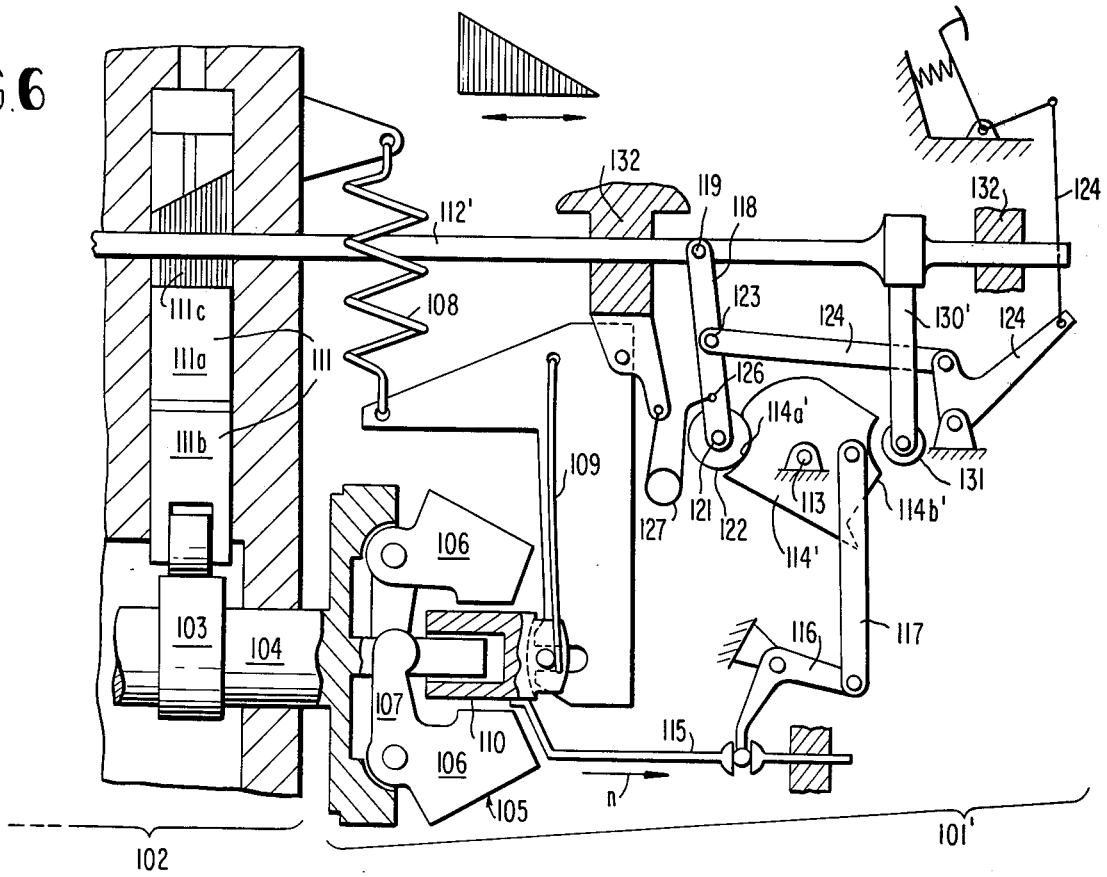

FIG. 4 is a diagram indicating the characteristic curves attainable with the control mechanism according to FIG. 3; and FIGS. 5 and 6 are somewhat schematic views of two further embodiments of a control mechanism according to the present invention with particularly simple control linkages whereby the two embodiments differ exclusively in the construction and operative connection of the adjusting lever and of the full load lever of the control linkage.

Figure 1:
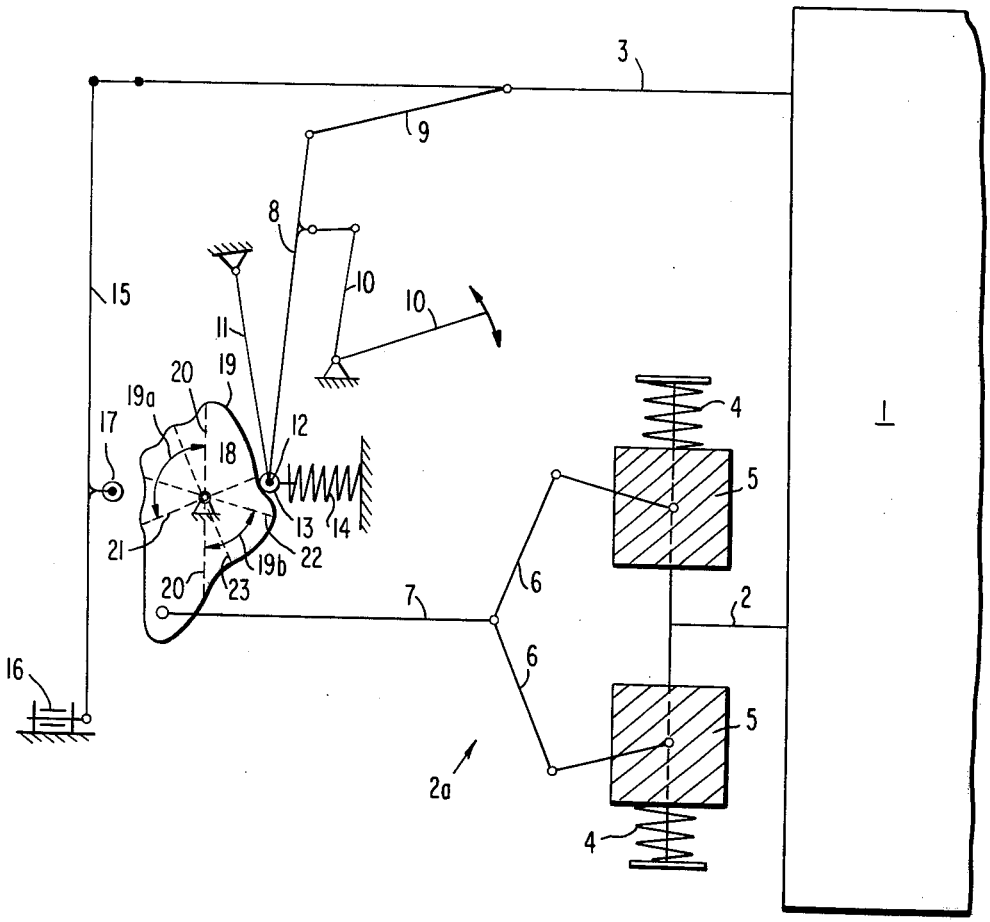
FIG. 1 is a schematic diagrammatic view of a control linkage for a fuel injection control mechanism in accordance with the present invention.

Referring now to the drawing wherein like the reference numerals are used throughout the various views to designate like parts, and more particularly to FIG. 1, thd injection pump 1 is indicated only schematically in this figure together with the pump shaft 2 rotating proportional to the engine rotational speed and with the axially displaceably supported control rod or rack 3 which varies the injection quantity upon axial displacement.

The centrifugal governor generally designated by reference numeral 2*a* is operatively connected with the pump shaft 2 in a conventional manner; the centrifugal governor 2 includes radially slidable fly-weights 5 supported externally against springs 4, which are able to adjust the sliding sleeve 7 by way of bell cranks 6. The control mechanism or regulator further includes the adjusting level 8, to the upper end of which is pivotally connected the control rod 3 by way of the coupling member 9. The power output lever 10, adjustable at will by the driver, is pivotally connected with the adjusting lever 8 in the center area thereof. The adjusting lever 8 includes a further joint 12 suspended at a relatively fixed point by way of a coupling member 11 arranged at an acute angle to the adjusting lever 8. A cam-follower roller 13 is supported in this further joint 12, which is pressed radially against the cam disk 19 to be further described more fully hereinafter by the spring 14. The further joint 12 is fixed by reason of the coupling member 11 and the abutment against the cam 19 to be considered at first as fixed or standing still and the control rod 3 can therefore be adjusted or displaced at will be way of the drive pedal 10.

The control rod 3 is extended beyond the point of pivotal connection with the coupling member 9 connecting the control rod 3 with the adjusting lever 8 and is pivotally connected thereat with an abutment lever 15. The abutment lever 15 is pivotally connected at the end opposite the control rod 3 and substantially parallel in the direction to the control rod movement with a fixed point adjustable by means of the adjusting screw 16. A cam-follower roller 17 is also arranged in the center area of the abutment lever 15 which in the full load position of the control rod 3, is operable to come into contact with the cam disk 19.

The cam disk 19 which is rotatable about the pivot point 18 and is displaced by the sliding sleeve 7 of the centrifugal governor 2*a* in case of rotational speed changes, is arranged between the mutually oppositely arranged cam-follower rollers 13 and 17; the sliding sleeve 7 is operatively connected by way of the pivotal bearing eye with an adjusting lever disposed at the cam disk 19 and depending on the rotational speed change, displaces the cam disk 19 by a more or less large angular amount. The entire possible displacement path or pivot path is indicated on the cam disk 19 by the two dash radial lines 20 and 21, more particularly the radial line 21 indicates the pivot position at zero rotational speed.

The cam disk 19 includes a cam surface 19*b* which becomes effective in the partial load range and extends over the entire pivot range between the lines 20 and 21, and a further cam surface 19*a* which becomes effective only at full load and which is disposed diametrically opposite to the cam surface 19*b*; the cam surface 19*a* thereby extends also over the entire pivot range. The pivot range of the cam disk 19 corresponding to the normal rotational speed range is indicated by a further pair of radial lines 22 and 23, and more particularly the radial line 22 reaches the position determined by the cam-follower roller 13 during idling rotational speed and the radial line 23 at the end rotational speed of the engine. The cam surface 19*b* includes within the relatively small pivot range corresponding to the rotational speed interval between rotational speed "zero" and "idling" rotational speed between the radial lines 21 and 22 a steeply rising cam flank (starting control flank) displacing the adjusting lever 8 and control rod 3 from a position corresponding to a high injection quantity suited for starting purposes to a position corresponding to a lower injection quantity; the steeply rising cam flank passes over into a circularly shaped cam portion of constant height (operating range) which extends between the radial lines 22 and 23.

In this range, no influence is exerted by the cam surface 19*b* on the further point of pivotal connection 12 of the adjusting lever 8 and the injection quantity is determined exclusively at will by the operating person by way of the drive lever or pedal 10. The end rotational speed control range which extends between the radial lines 23 and 20 adjoins the operating range 22 - 23 of the cam surface 19*b;* the end rotational speed conrol range 23 - 20 again includes a steeply rising flank displacing the control rod 3 in the sense of an injection quantity reduction during a pivotal cam movement in the counterclockwise direction.

Figure 2:
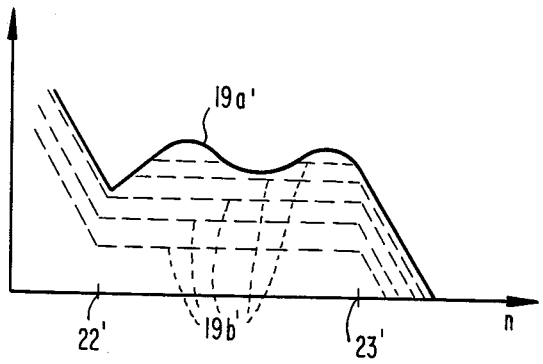
FIG. 2 is a diagram showing the characteristic curves including the full load line attainable with the control mechanism of FIG. 1.

The effect of this cam on the control behavior of the control mechanism is illustrated in the diagram of FIG. 2, in which the displacement path of the control rod 3 is indicated purely quantitatively without any graduation along the ordinate axis and the engine or pump rotational speed *n* is applied along the abscissa axis. The position of idling rotational speed and end rotational speed is indicated along the abscissa by reference numerals 22' and 23', respectively. The partial load curves 19*b'*, i.e., the lines of identical position of the drive lever 10 are indicated in dash lines. One can readily recognize the diagram typical for filling or fuel injection control of partial load curves together with the control portion below the idling rotational speed, with constant injection quantity over the operating rotational speed range and with the reducing control portion above the end rotational speed.

The position of the cam-follower roller 17 is so adjusted radially in relation to the full load cam surface 19*a* by means of the adjusting screw 16 that the cam-follower roller 17 does not yet contact the cam surface 19*a* in partial load positions of the control rod 3. Only toward the end of the partial load range, the cam-follower roller 17 approaches the cam surface 19*a* by reason of a position of the control rod 3 displaced more strongly toward the right in the direction toward larger injection quantities.

Higher raised portions on the cam surface 19*a* then already contact the cam-follower roller 17 and in case of a pivoting of the cam 19 lead to a displacement of the cam-follower roller 17 toward the left and therewith by way of the lever 15 to a displacement of the control rod 3 in the direction toward smaller injection quantities. In the full load range, the cam-follower roller 17 therefore comes into abutment at the cam surface 19*a* and the full load cam surface becomes effective. The cam surface 19*a* has to be determined for each engine type and for each type of injection pump by tests and by corresponding conversion calculations of the test results into cam curve points, i.e., the contour of the cam surface is determined empirically for each engine type and injection type and the test results are converted by calculations into points of the cam surface. If the cam-follower roller 17 has come into abutment at the full load cam surface 19*a,* then the injection quantity is determined exclusively by the engine rotational speed and the cam position corresponding thereto. A further depressing of the drive pedal or drive lever 10 then remains without influence on the control rod position. In the full load range instead the pivotal connection of the adjusting lever 8 at the control rod 3 by way of the coupling member 9 has to be considered as spatially fixed and a depressing of the drive lever 10 would then effect only a lifting-off of the cam-follower roller 13 from the partial load cam surface 19*b* against the force of the spring 14.

The operation of the full load cam surface 19*a* on the control behavior of the control mechanism is also clearly illustrated in diagram form in FIG. 2. The family of the partial load lines 19*b'* indicated in dash line are intersected by the full load limit lines 19*a'* illustrated in full lines and determined in the configuration thereof by the shape of the cam surfaces 19*a.* The partial load diagram reaches within the operating rotational speed range more or less high areas of the control rod position depending on the rotational speed. By a suitable configuration of the full load cam 19*a,* it is assured that both below the idling rotational speed 22' and above the end rotational speed 23', the full load limitation has an analogous course in comparison to the partial load limitation. In the operating rotational speed range therebetween, however, the full load limitation is determined according to completely individual or peculiar complicated mathematical interrelationships in such a manner that within the operating rotational speed range the installed power output can be utilized in a most far-reaching manner under maintenance of the smoke limit.

The control mechanism illustrated in FIG. 3 is constructed in principle exactly in the same manner as the control mechanism according to FIG. 1 and the same parts are designated by the same reference numerals so that with respect to the construction and operation thereof, reference may be had to the preceding descriptive passages. Only the adjusting lever 8 engages no longer with its further joint 12' directly at the cam-follower roller 13 but instead at a point of the rocker or pivot lever 11 somewhat further away from the fixed point of rotation. Furthermore, the sliding sleeve 7 no longer engages directly at the cam disk 19 but instead by way of a pivot lever 7' and a coupling member 7''. Furthermore, the full load abutment rod 15 is not pivotally connected directly at the control rod 3 but is pivotally connected therewith by way of the coupling member 9'. These differences, however, are of secondary nature.

As decisive difference of the control mechanism according to FIG. 3 with respect to that of FIG. 1, which determines the control behavior, should be mentioned the shape of the cam 19*b''* which extends with a rising slope over the entire pivot range between the radial lines 21 and 20. By reason of this rising configuration of the partial load cam 19*b''*, a cam portion exists within the entire pivot range which displaces the cam-follower roller 13. The transmission of the control linkage from the cam-follower roller 13 to the control rod 3 is with an increase, i.e., a small horizontal movement of the cam-follower roller 13 initiates a considerably larger horizontal movement of the control rod 3 and more particularly by a movement of the cam-follower roller 13 toward the right by about 1 mm. (rotational speed increase) the control rod 3 is pulled toward the left by about 5 mm. (injection quantity control). By reason of this transmission with an increase, a constant control characteristic can be obtained with a single continuously rising cam surface 19*b''* fixedly mounted at the cam disk 19. The reason that at higher rotational speeds the cam has a higher level at the place where the cam-follower 13 engages than at smaller rotational speeds is compensated by the fact that the output lever 10 assumes another position at a higher rotational speed than at small rotational speeds.

The operation of the cam 19*b*'' on the control behavior of the control mechanism according to FIG. 3 is indicated in diagram in FIG. 4, which coincides with respect to the significance and position of the coordinate axes and the full load limit curve to the diagram of FIG. 2; consequently, reference may be had to corresponding descriptive passages of FIG. 2.

By preselection of a certain position of the injection quantity lever 10, one of the lines 19*b*''' is selected, and the control mechanism operates along this control line selected by the lever position. With a load increase, the rotational speed at first decreases and the filling (fuel injection) is somewhat increased so that the engine again rises in the rotational speed, however, not quite up to the original value. With a load increase, upon completion of the control operation after the usual fade-out or decay, the rotational speed will have dropped somewhat and the injection pump will be adjusted to higher injection quantities. This rotational speed decrease and control rod adjustment will thereby continue with load increases and awaiting of the stationary operation for such length of time until the cam-follower roller 17 contacts the full load cam 19*a* and corresponding thereto the operating point has "slipped up" along the partial load curve 19*b*''' to the full load curve 19*a*'. A further increase of the load of the engine is then not possible any longer. Each individual partial load curve 19*b*''' in the diagram of FIG. 4 corresponds to a predetermined length section on the partial load cam 19*b*'' and each end point of the length section corresponds to a very definite rotational speed and a very definite point along the full load curve 19*a*' or on the full load cam 19*a*. The coordination of the upper end points of the individual partial load control curves to the full load limit curve is therefore unequivocal.

Up to now, greater emphasis was placed in the description given so far on the functional control behavior. In the two following embodiments of the control mechanism illustrated in FIGS. 5 and 6 which will be described more fully hereinafter, the constructive aspects are of greater importance, which, of course, will also have an effect from a functional point of view, as will be explained more fully hereinafter.

The two embodiments according to FIGS. 5 and 6 and the details thereof will at first be explained in common insofar as agreement exists therebetween. The control mechanism 101 (FIG. 5) and 101' (FIG. 6) is arranged at a partially illustrated injection pump 102 of conventional construction. The pump 102 includes a pump shaft 104 provided with feed cams 103; the pump shaft 104 also carries the centrifugal governor of any conventional construction and generally designated by reference numeral 105 which includes the fly-weights 106. The radially tiltable supported rotating fly-weights 106 carry radially projecting arms 107 which act on an axially movable, non-rotating sliding sleeve 110 which is under the influence of the axial prestress of springs 108 and 109 and depending on the magnitude of the rotational speed of the pump shaft 104 displace the sliding sleeve 110 into a different axial position. As a result of a rotational speed increase, the sliding sleeve 110 is displaced in the direction of the arrow *n*. The injection pump 102 further includes several feed pistons 111 reciprocated up and down by a respective cam 103 of the pump shaft 104, whose upper portion 111*a* is rotatable about the piston axis with respect to the lower piston portion 111*b*. The upper piston portion 111*a* is so constructed that, depending on the rotational position of this piston portion, a more or less large proportion of the actually executed piston stroke is utilized for the fuel feed (feed stroke). For purposes of rotation, the upper piston portion 111*a* includes a shaft portion 111*c* provided with straight teeth, into which engage the rack teeth (not shown) of the axially movably supported control rod or rack 112 and 112'. The upper portion 111*a* of the piston 111 is rotated by an axial displacement of the control rod 112 or 112' and thus the magnitude of the feed stroke, i.e., the injection quantity of the pump 102 is changed depending on the piston stroke. More particularly, by a displacement of the control rod 112 or 112' into the pump, the injection quantity is increased and in the other direction the injection quantity is reduced, as is indicated by the cross-hatched triangle above the control rod 112 and 112'.

A cam disk 114 and 114' rotatably supported about a fixed point 113 is additionally arranged in the control mechanism 101 and 101', respectively which is operatively connected with the sliding sleeve 110 by way of the push rod 115, the bell crank 116 and the coupling member 117. The axial sliding sleeve movements are transmitted directly onto the cam disk 114 and 114' by way of this connecting linkage 115 – 117 and are converted into corresponding angular movements. The axis of rotation 113 of the cam disk 114 and 114' is arranged perpendicularly to the control rod 112 and 112' and/or to the pump shaft 104 and the cam disk 114 or 114' extends parallel to the plane of the drawing. The cam disk 114 and 114' each includes two different cam surfaces 114*a* and 114*b* and 114*a*' and 114*b*', respectively, whose one cam surface (partial load cam surface 114*a* and 114*a*') is effective in the partial load range and whose other cam surface (full load cam surface 114*b* and 114*b*') is effective at full load of the associated combustion engine (not shown) as will be explained more fully hereinafter.

A rotatable and parallelly displaceable lever, the so-called adjusting lever 118 which is provided in the control mechanism, is operatively connected with one end thereof at least indirectly with the associated control rod at the point of pivotal connection 119, and more particularly in the embodiment according to FIG. 5 by way of the intermediate member 120 and in the embodiment of FIG. 6 directly. The cam-follower roller 122 is arranged on the pivot shaft 121 at the other end of the adjusting lever 118. The point of pivotal connection 123 is arranged approximately on the straight connecting line between the two points of engagement 119 and 121; the adjusting linkage 124 is pivotally connected with the adjusting lever 118 at the point of pivotal connection 123. The adjusting linkage 124 and together with the same the adjusting lever 118 are actuatable at will by the driver by means of the pedal 125 (fuel quantity lever).

A further point of pivotal connection 126 for the return spring 127 is arranged intermediate the two points of pivotal connection 121 and 123 for the cam-follower roller 122 and for the adjusting linkage 124; the return spring 127 is constructed as double leg spring. The point of pivotal connection 126 of the spring is arranged not only intermediate the aforementioned points of pivotal connection 121 and 123 but at the same time also between the points of pivotal connection 121 and 119. Owing to this arrangement of the point of pivotal connection of the spring, the spring 127 can assume two functions, namely, as abutment spring which presses the cam-follower roller 122 against the cam surface 114*a* or 114*a'* and, on the other, as return spring which in case of a breakage or rupture in the adjusting linkage 124, automatically displaces the control rod 112 and 112' in the direction toward "idling".

In the control mechanism according to FIG. 5, the point of pivotal connection 119 between the adjusting lever 118 and the control rod 112 is guided along a large circular arc by way of a rocker arm or swinging lever 128, rotatably supported in a spatially fixed point of rotation 129. The rocker arm or swinging lever 128 is constructed quite long so that the point of rotation 129 lies below the contour of the cam disk 114. The rocker arm or swinging lever 128 is constructed as bell crank 128 - 130 by the provision of a small bracket 130. At the outer end of the bracket 130 is arranged the cam-follower roller 131 which cooperates with the full load cam surface 114*b*. By reason of the arrangement of the bracket 130 together with the roller 131 at the rocker arm or swinging lever 128, the latter assumes two functions, and more particularly it serves, on the one hand, for the guidance of the point of pivotal connection 119 along a circular arc tangential to the movement direction of the control rod 112 and additionally, as full load limit lever for the control rod. By reason of the bearing support of the full load limit lever 128 - 130 in a spatially fixed point, it only has one degree of freedom of movement; it is positively coupled with the control rod 112 and therefore—as seen—can assume the function of the full load limitation depending on the configuration of the cam shape of the full load cam 114*b* displaced in dependence on the rotational speed.

By reason of this consolidation of the functions in the bell crank 128/130, at least one lever and several coupling places with corresponding play are economized whereby the lost motions and the inertia mass of the control linkage are reduced.

Still fewer coupling places and correspondingly still less lost motion are obtainable with the embodiment of the control mechanism according to FIG. 6. In this control mechanism, the control rod 112' is extended up to within the area of the regulator or control mechanism 101' and is longitudinally displaceably supported also within this area in slide bearings 132 of any conventional construction. Owing to this guidance, the full load abutment lever 130' carrying the cam-follower roller 13' cooperating with the full load cam surface 114*b'*, can be immovably secured at the control rod 112'. The adjusting lever 118 is coupled directly to the control rod 112' in the pivot bearing eye 119. The full load abutment lever 130' is movable only in one direction of movement and is positively taken along by the control rod 112'. The adjusting lever 118 is movable in two ways, namely, parallel to itself in the movement direction of the control rod 112' and rotatable about the point 123 or about the point 121.

Owing to this construction and coupling connection of the control linkage, the control mechanism according to FIG. 6 exhibits a particularly small lost motion.

The operation of the two control mechanisms illustrated in FIGS. 5 and 6 will now be explained in common for both control mechanisms: In the partial load range, by reason of a center position of the adjusting linkage 124, of the cam disk 114 and of the control rod 112 or 112', the full load limit lever 130 or 130' and the cam-follower roller 131 thereof are in a lifted-off position—as illustrated. Within this range, the full load cam surface 114*b* and 114*b'* and the associated lever 130/131 or 130'/131' are completely ineffectual as if they did not exist at all. The control behavior is determined within this range by the centrifugal governor 105, by the shape of the partial cam surface 114*a* and 114*a'* and by the selective movements, at will, of the adjusting linkage 124. By reason of the prestress of the spring 127 and of the arrangement of its point of engagement 126 at the adjusting lever 118 between the two points of pivotal connection 121 and 123, the inclination of the adjusting lever 118 with respect to the perpendicular on the control rod 112 and 112' is determined by the relative position of the two points of pivotal connection 121 and 123 in the horizontal direction, i.e., in the movement direction of the control rod 112 and 112'. The displacement of the adjusting lever point 123 in the movement direction of the control rod 112 and 112' is effected by the adjusting linkage 124 actuatable at will, and the horizontal coordinates of the other adjusting lever point is determined by the cam surface displaced in dependence on the rotational speed. Each pairing of horizontal coordinates of the two adjusting lever points 121 and 123 has as a consequence a corresponding horizontal coordinate of the point of pivotal connection 119 and therewith of the control rod 112 and 112'. An increasing adjustment of the adjusting linkage 124 in the direction of "full" brings about in principle a displacement of the control rod 112 and 112' toward the left and vice versa. The partial load cam surface 114*a* and 114*a'* which is dependent on the rotational speed brings about, especially in the end ranges of the operating rotational speed, a superimposition of the adjusting lever movement in order to obtain a desired progress of the control rod position as a function of load and rotational speed.

The lever lengths and cam surface radii of the control linkage are so matched to one another as regards the associated system of the engine and injection pump that at the moment when the full load point of the engine—variable as a function of rotational speed—is reached, the cam-follower roller 131 of the full load limit lever 130 and 130' comes into contact with the full load cam surface 114*b* and 114*b'*. At the moment of the contact, a further movement of the control rod 112 or 112' toward "full" at constant rotational speed is no longer possible, even with an adjusting linkage movement directed toward such increase. The control mechanism behavior is determined at full load exclusively by the full load limit lever 130 and 130', by the shape of the full load cam surface 114*b* and 114*b'* and by the sliding sleeve movement. The cam-follower roller 122 of the adjusting lever 118 lifts off during the engagement of the other cam-follower roller 131 and the adjusting lever 118, the partial load cam surface 114*a* and 114*a'* and the adjusting linkage are completely ineffectual at full load. At full load, a control rod movement is possible at best only in case of rotational speed changes. Selective adjusting movements at will by the driver are without influence; they lead merely to a further lifting off of the roller 122 from the partial load cam surface 114*a* and 114*a'*.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. In an internal combustion engine having a predetermined operating range and an injection pump which supplies fuel to said engine over said operating range, a control mechanism for controlling said injection pump, said control mechanism comprising:

a control rod member axially displaceable in the injection pump for directly varying the injection quantity of said pump as a function of the position of said control rod member, a freely movable injection pump adjusting lever, means for connecting the control rod member with said adjusting lever, an arbitrarily operable fuel quantity lever, means for connecting said fuel quantity lever to said adjusting lever, speed responsive governor means including a governor member movable as a function of the speed of an internal combustion engine, movable cam means defining first and second linear cam surfaces, a motion connecting means interposed between said cam means and said movable governor member for moving said cam means in response to the movement of said governor member, a first cam follower selectively engageable with a first of the linear cam surfaces, a second cam follower relatively engageable with a second of the linear cam surfaces, means for mounting said first cam follower to said adjusting lever at a fixed location such that the position of said adjusting lever controls the position of said control rod member in response to the position of the cam means over a first portion of the operating range of said engine, means for mounting said second cam follower to said control rod member such that when said second cam follower contacts said cam means over a second portion of the operating range of said engine, a displacement of said control rod member in a direction permitting higher quantities of fuel to be injected in the engine is blocked, said means for mounting said first cam follower to said adjusting lever, said means for mounting said second cam follower to said control rod member, said means for connecting said control rod member with said adjusting lever, and said means for connecting said fuel quantity lever to said adjusting lever being arranged with respect to one another so that in each case only one of said first cam follower and said second cam follower respectively contact their associated cam surfaces with the respective cam followers being alternatingly mutually disengageable from their associated cam surfaces.

2. A control mechanism according to claim 1, wherein said movable governor member includes a sliding sleeve means operatively connected to said motion connecting means.

3. A control mechanism according to claim 1, wherein the internal combustion engine is a Diesel engine.

4. A control mechanism according to claim 2, wherein means are provided for mounting said cam means so as to be pivoted by a displacement of the sliding sleeve means.

5. A control mechanism according to claim 1, wherein the first cam surface is effective during a partial load operation of the internal combustion engine.

6. A control mechanism according to claim 5, wherein the second cam surface means is effective during a full load operation of the internal combustion engine.

7. A control mechanism according to claim 1, wherein the first cam surface, in a position corresponding to a standstill of the engine, has an outer contour engageable by said first cam follower so as to cause a displacement of the control rod member to a position corresponding to a relatively large amount of fuel injection suitable for engine starting purposes, and in a range between an engine starting position and an idling position, has an outer contour engageable by said first cam follower so as to cause a displacement of the control rod member to a position corresponding to a relatively lesser quantity of fuel injection suitable for idling of the internal combustion engine.

8. A control mechanism according to claim 7, wherein the first cam surface has a predetermined outer contour corresponding to a normal operating rotational speed range of the engine, and wherein a displacement of the cam means to the maximum rotational speed range results in the first cam follower displacing the control rod member to positions of lesser injected fuel quantities.

9. A control mechanism according to claim 8, wherein said predetermined outer contour of the first cam surface has an at least approximately constant height.

10. A control mechanism according to claim 8, wherein said predetermined outer contour of the first cam surface has an at least approximately continuously sloping configuration.

11. A control mechanism according to claim 1, wherein the first cam surface is provided with a depression therein, said first cam follower contacting said depression during an engine standstill whereby the control rod member is displaced to a position corresponding to an injection quantity suitably large for engine starting purposes, and wherein a rising cam flank is provided on said first cam surface adjacent said depression, said rising cam flank corresponding to a rotational speed interval between zero and idling rotational speed, said first cam follower engaging said rising cam flank within the rotational speed interval between zero and idling rotational speed whereby said control rod member is retracted by a displacement path corresponding to the reduction from a starting injection quantity to an idling injection quantity.

12. A control mechanism according to claim 11, wherein the first cam surface includes an at least approximately constant cam level surface adjoining said rising cam flank, said constant cam level surface corresponding substantially to the entire operating rotational speed range of the internal combustion engine, and wherein a second rising cam flank is arranged on said first cam surface adjacent said constant cam level surface, said first cam follower engaging said second rising cam flank so as to effect a displacement of the control rod member to reduce an injection quantity.

13. A control mechanism according to claim 11, wherein the first cam surface has an at least approximately constantly rising cam surface portion adjoining said rising cam flank, said constantly rising cam surface portion corresponding substantially to the entire operating rotational speed range of the internal combustion engine.

14. A control mechanism according to claim 13, wherein said means for mounting said first can follower to said adjusting lever includes a pivotally mounted coupling member having mounted thereon said first camfollower, said adjusting lever being pivotally mounted to said coupling member such that an actuating linkage results between said first cam follower and said control rod member which has a transmission ratio such that, with a movement of the cam means of only a fraction of the entire movement range thereof, the control rod member is displaced by at least approximately a full stroke of the control rod member.

15. A control mechanism according to claim 1, wherein said first and said second cam surfaces are provided on a common member, and wherein said first cam surface is a partial load cam surface for the partial load control of the internal combustion engine and said second cam surface is a full load cam surface for the full load limitation of the internal combustion engine.

16. A control mechanism according to claim 1, wherein said means for connecting said fuel quantity lever to said adjusting lever includes an adjusting linkage means interposed between the fuel quantity lever and the adjusting lever, said means for mounting said second cam follower to said control rod member includes a lever means mounted so as to have at least one degree of freedom of movement in a direction toward and away from said second cam surface, and wherein said adjusting lever is mounted at the control mechanism so as to be movable in the direction of a stroke of the control rod member and in the direction toward and away from said first cam surface with one degree of freedom of movement and in an actuating direction of the adjusting linkage means with a further degree of freedom of movement.

17. A control mechanism according to claim 16, wherein said adjusting linkage means is pivotally connected to said adjusting lever and said adjusting lever is pivotally connected to said control rod member, and wherein the pivotal connections of the adjusting linkage means and said control rod member are arranged at different places along the adjusting lever means.

18. A control mechanism according to claim 17, wherein means are provided for positively coupling said lever means to the control rod member.

19. A control mechanism according to claim 17, wherein said cam means is rotatably supported about an axis extending substantially perpendicularly to a longitudinal axis of the control rod member.

20. A control mechanism according to claim 19, wherein said first and second cam surfaces include raised portions extending substantially radially to the axis of rotation of said cam means.

21. A control mechanism according to claim 20, wherein the pivotal connection of said adjusting linkage means to said adjusting lever and a center point of the second cam follower are arranged on at least an approximately straight line.

22. A control mechanism according to claim 21, wherein the pivotal connection of the adjusting linkage means to the adjusting lever is arranged on the adjusting lever between the pivotal connection of the adjusting lever means to the control rod means and the means for mounting the first cam follower to said adjusting lever.

23. A control mechanism according to claim 22, wherein said first cam follower is mounted to said adjusting lever such that said first cam follower executes movements at least approximately perpendicularly to the movement direction of the cam means.

24. A control mechanism according to claim 23, wherein a spring means is operatively connected with the adjusting lever for normally urging said first cam follower against the first cam surface.

25. A control mechanism according to claim 24, wherein said spring means engages said adjusting lever at a point arranged between the pivotal connection of the adjusting linkage means with the adjusting lever and the first cam follower.

26. A control mechanism according to claim 25, wherein the lever means and the adjusting lever, at least with respect to that effective lever portion that is operatively connected with the control rod member, are arranged in the control mechanism at least approximately parallel to one another and at least approximately at right angle to the control rod member.

27. A control mechanism according to claim 26, wherein said means for connecting said adjusting lever with the control rod member includes an intermediate member pivotally connected to said adjusting lever and control rod member, said intermediate member being arranged at least approximately coaxially to the control rod member, the effective length of the adjusting lever between the pivotal connection thereof with the control rod member and the first cam-follower corresponding approximately to a perpendicular distance between the axis of the control rod member and the axis of rotation of the cam means.

28. A control mechanism according to claim 27, wherein said means for mounting said second cam follower to said control rod member includes a fixed pivot bearing means for pivotally supporting said lever means, said lever means being positively coupled to said control rod member by said positive coupling means at the pivotal connection of said adjusting lever with said control rod member whereby said lever means guides the pivotal connection along a substantially circular arc.

29. A control mechanism according to claim 28, wherein said lever means is disposed in the control mechanism so as to extend generally in the direction of the adjusting lever.

30. A control mechanism according to claim 29, wherein the fixed pivot bearing means of the lever means is arranged in the control mechanism at a greater distance from the control rod member than the axis of rotation of the cam means.

31. A control mechanism according to claim 30, wherein said lever means is fashioned as a bell crank with said second cam follower being arranged on the bell crank at a position of the cam means corresponding to said second cam surface.

32. A control mechanism according to claim 16, wherein said adjusting linkage means is pivotally connected to said adjusting lever and wherein the pivotal connection of the adjusting linkage means and a center point of the first cam follower are arranged on said adjusting lever along at least an approximately straight line.

33. A control mechanism according to claim 16, wherein said adjusting linkage means is pivotally connected to said adjusting lever and said adjusting lever is pivotally connected to said control rod member, and wherein the pivotal connection of the adjusting linkage means to the adjusting lever is arranged between the pivotal connection of the adjusting lever to said control rod member and a center point of the first cam follower.

34. A control mechanism according to claim 16 wherein wherein said first cam follower is mounted to said adjusting lever such that said first cam follower executes movements at least approximately perpendicularly to the movement direction of the cam means.

35. A control mechanism according to claim 16, wherein a spring means is operatively connected with the adjusting lever for normally urging said first cam follower against the first cam surface.

36. A control mechanism according to claim 35, wherein said adjusting linkage means is pivotally connected to said adjusting lever and said adjusting lever is pivotally connected to said control rod means, and wherein said spring means engages said adjusting lever at a point arranged between the pivotal connection of the adjusting linkage means with the adjusting lever and the first cam-follower.

37. A control mechanism according to claim 16, wherein the lever means and the adjusting lever, at least with respect to that effective lever portion that is operatively connected with the control rod member, are arranged in the control mechanism at least approximately parallel to one another and at least approximately at right angle to the control rod member.

38. A control mechanism according to claim 16, wherein said means for connecting said adjusting lever with the control rod member includes an intermediate member pivotally connected to said adjusting lever and control rod member, said intermediate member being arranged at least approximately coaxially to the control rod member, the effective length of the adjusting lever between the pivotal connection thereof with the control rod member and the first cam-follower corresponding approximately to a perpendicular distance between the axis of the control rod member and the axis of rotation of the cam means.

39. A control mechanism according to claim 38, wherein said means for mounting said second to said control rod members further includes a fixed pivot bearing means for pivotally supporting said lever means, said lever means being positively coupled to said control rod member by said positive coupling means at the pivotal connection of said adjusting lever with said control rod member whereby said lever means guides the pivotal connection along a substantially circular arc.

40. A control mechanism according to claim 39, wherein said lever means is disposed in the control mechanism so as to extend generally in the direction of the adjusting lever.

41. A control mechanism according to claim 40, wherein the fixed pivot bearing means of the lever means is arranged in the control mechanism at a greater distance from the control rod member than the axis of rotation of the cam means.

42. A control mechanism according to claim 41, wherein said lever means is fashioned as a bell crank with said second cam follower being arranged on the bell crank at a position of the cam means corresponding to said second cam surface.

43. A control mechanism according to claim 16, wherein said lever means mounts said second cam follower in the control mechanism so that said second cam follower is guided radially toward and away from said second cam surface and substantially parallel to itself.

44. A control mechanism according to claim 43, wherein said lever means is directly connected to said control rod member whereby said lever means is guided by the control rod member itself.

45. A control mechanism according to claim 1, wherein said means for connecting said adjusting lever to said control rod member is a pivot means, said means for connecting said fuel quantity lever to said adjusting lever includes an adjusting linkage interposed between said fuel quantity lever and said adjusting lever, said pivot means and adjusting linkage being arranged in the control mechanism so that the adjusting lever is rotatably as well as locally movably supported.

46. A control mechanism according to claim 1, wherein said second cam follower mounting means includes a lever means for mounting said second cam follower in the control mechanism so that said second camfollower is guided radially toward and away from said second cam surface and substantially parallel to itself.

47. A control mechanism according to claim 1, wherein said lever means is directly connected to said control rod member whereby said lever means is guided by the control rod member itself.

48. A control mechanism according to claim 1, wherein a connecting part is rigidly connected at the control rod member, said means for connecting said adjusting lever to said control rod member including a pivot means or pivotally connecting said adjusting lever to said connecting part.

49. A control mechanism according to claim 1, wherein said means for connecting said control rod member to said adjusting lever is a pivot means for pivotally connecting said adjusting lever with the control rod member.

50. A control mechanism according to claim 1, wherein said cam means is rotatably supported about an axis extending substantially perpendicularly to a longitudinal axis of the control rod member.

51. A control mechanism according to claim 50, wherein said first and second cam surfaces include raised portions extending substantially radially to the axis of rotation of said cam means.

52. A control mechanism according to claim 1, wherein said means for connecting said adjusting lever to said control rod member is a pivot means, and wherein said pivot means and a center point of said first cam follower are arranged on at least an approximately straight line.

53. A control mechanism according to claim 1, wherein said means for connecting said fuel quantity lever to said adjusting lever includes an adjusting linkage pivotally connected to said adjusting lever and said fuel quantity lever, said means for connecting said control rod member with said adjusting lever includes a pivot means, and wherein the pivotal connection of the adjusting linkage means at the adjusting lever is arranged between the pivot means and a center point of the first cam follower

54. A control mechanism according to claim 1, wherein said first cam follower is mounted to said adjusting lever such that said first cam follower executes movements at least approximately perpendicularly to the movement direction of the cam means.

55. A control mechanism according to claim 1, wherein a spring means is operatively connected with the adjusting lever for normally urging said first cam follower against the first cam surface.

56. A control mechanism according to claim 55, wherein said means for connecting the control rod member to the adjusting lever includes an intermediate member interposed between said adjusting lever and said control rod member, and a pivot means for pivotally connecting said adjusting lever to said intermediate member, and wherein said means for mounting said second cam follower to said control rod member includes a lever means, said mounting means mounting said lever means in the control mechanism so that said lever means guides the pivotal connection of the adjusting lever at the intermediate member along a substantially circular arc.

57. A control mechanism according to claim 56, wherein said lever means is disposed in the control mechanism so as to extend generally in the direction of the adjusting lever.

58. A control mechanism according to claim 56, wherein said second cam follower means further includes a fixed pivot bearing means arranged in the control mechanism at a greater distance from the control rod member than a center point of the cam means.

59. A control mechanism according to claim 56, wherein said lever means is fashioned as a bell crank with said second cam follower being arranged on the bell crank at a position of the cam means corresponding to said second cam surface.

60. A control mechanism according to claim 55, wherein said means for connecting said fuel quantity lever to said adjusting lever includes an adjusting linkage pivotally connected to said adjusting lever and said fuel quantity lever, said means for connecting said control rod member to said adjusting lever includes a pivot means, and wherein said spring means engages said adjusting lever at a point arranged between the pivotal connection of the adjusting linkage means with the adjusting lever and first cam-follower.

61. A control mechanism according to claim 1, wherein said means for connecting said adjusting lever with the control rod member includes an intermediate member pivotally connected to said adjusting lever and control rod member, said intermediate member being arranged at least approximately coaxially to the control rod member, the effective length of the adjusting lever between the pivotal connection thereof with the control rod member and the first cam-follower corresponding approximately to a perpendicular distance between the axis of the control rod member and an axis of rotation of the cam means.

62. A control mechanism according to claim 1, wherein said means for mounting said second cam follower to said control rod member includes a lever means for mounting said second cam follower so as to be guided radially toward and away from the second cam surface and substantially parallel to itself.

63. A control mechanism according to claim 1, wherein said means for mounting said second cam follower to said control rod member includes a lever means, immovably secured to said control rod member whereby said lever means is guided by said control rod member.

64. A control mechanism according to claim 1, wherein said first portion of said operating range corresponds to partial load engine operating conditions and said second portion corresponds to full load engine operating conditions.

65. A control mechanism according to claim 64, wherein the first cam surface is provided with a depression therein, said first cam follower contacting said depression during an engine standstill whereby the control rod member is displaced to a position corresponding to an injection quantity suitably large for engine starting purposes, and wherein a rising cam flank is provided on said first cam surface adjacent said depression, said rising cam flank corresponding to a rotational speed interval between zero and idling rotational speed, said first cam follower engaging said rising cam flank within the rotational speed interval between zero and idling rotational speed whereby said control rod member is retracted by a displacement path corresponding to the reduction from a starting injection quantity to an idling injection quantity.

66. A control mechanism according to claim 65, wherein the first cam surface includes an at least approximately constant can level surface adjoining said rising cam flank, said constant cam level surface corresponding substantially to the entire operating rotational speed range of the internal combustion engine, and wherein a second rising cam flank is arranged on said first cam surface adjacent said constant cam level surface, said first cam follower engaging said second rising cam flank so as to effect a displacement of the control rod member to reduce an injection quantity.

67. A control mechanism according to claim 65, wherein the first cam surface has an at least approximately constantly rising cam surface portion adjoining said rising cam flank, said constantly rising cam surface portion corresponding substantially to the entire operating rotational speed range of the internal combustion engine.

68. A control mechanism according to claim 67, wherein said means for mounting said first cam follower to said adjusting lever includes a pivotally mounted coupling member having mounted thereon said first cam follower, said adjusting lever being pivotally mounted to said coupling member such that an actuating linkage results between said first cam follower and said control rod member which has a transmission ratio such that, with a movement of the cam means of only a fraction of the entire movement range thereof, the control rod member is displaced by at least approximately a full stroke of the control rod member.

69. A control mechanism according to claim 64, wherein a connecting part is rigidly connected at the control rod member, said means for connecting said adjusting lever to said control rod member including a pivot means for pivotally connecting said adjusting lever to said connecting part.

70. A control mechanism according to claim 64, wherein said means for connecting said control rod member to said adjusting lever is a pivot means for pivotally connecting said adjusting lever with the control rod member.

71. A control mechanism according to claim 1, wherein said means for mounting said second cam follower to said control rod member is an abutment lever means pivotally connected to said control rod member.

72. A control mechanism according to claim 71, wherein said second cam follower mounting means further includes means for adjusting said abutment lever means relative to said cam means.

73. A control mechanism according to claim 72, wherein said second cam follower is arranged on said abutment lever means between said adjusting means and said control rod member.

74. A control mechanism according to claim 73, wherein said first portion of said operating range corresponds to partial load engine operating conditions and said second portion corresponds to full load engine operating conditions.

75. A control mechanism according to claim 1, wherein said means for mounting said first cam follower to said adjusting lever includes a pivot lever, one end of said pivot lever being pivotally mounted at a portion of the control mechanism and the other end of said pivot lever being pivotally connected to a first end of said adjusting lever, and said means for connecting said adjusting lever to said control rod member includes a pivot pin means arranged at the other end of said adjusting lever, and wherein said means for connecting said fuel quantity lever to said adjusting lever is arranged between said pivot pin means and the pivotal connection between said pivot lever and said adjusting lever.

76. A control mechanism according to claim 75, wherein a spring means is interposed between a fixed portion of the control mechanism and said pivot lever in the area of the pivotal connection between the pivot lever and the adjusting lever for normally urging said first cam follower into engagement with said cam means.

77. A control mechanism according to claim 76, wherein said first portion of said operating range corresponds to partial load engine operating conditions and said second portion corresponds to full load engine operating conditions.

78. A control mechanism according to claim 1, wherein said means for connecting the control rod member with said adjusting lever is a first pivot means, said means for connecting said fuel quantity lever with said adjusting lever is a second pivot means spaced from said first pivot means and wherein said means for mounting said first cam follower to said adjusting lever is a third pivot means spaced from said first and second pivot means.

79. A control mechanism according to claim 78, wherein said second cam follower mounting means includes a lever means positively coupled to said control rod member.

80. A control mechanism according to claim 79, wherein said second pivot means is arranged between said first and third pivot means.

81. A control mechanism according to claim 78, wherein said second pivot means is arranged between said first and third pivot means.

82. A control mechanism according to claim 78, wherein said means for connecting said control rod member with said adjusting lever is a first pivot means, said means for connecting said fuel quantity lever with said adjusting lever is a second pivot means, and wherein said means for mounting said first cam follower to said adjusting lever includes a lever means having a first end pivotally connected to a portion of the control mechanism and a second end pivotally connected to said adjusting lever, said first cam follower being arranged on said lever means between the first and second ends thereof.

83. A control mechanism according to claim 82, wherein said second pivot means is arranged between said first pivot means and the point of pivotal connection of said adjusting lever and said lever means.

84. A control mechanism according to claim 83, wherein said second cam follower means includes a further lever means having a first end thereof connected to said control rod member, a second end thereof adjustably mounted at the control mechanism, and wherein said second cam follower is arranged on said further lever means between said control rod member and the second end of said further lever means.

85. A control mechanism according to claim 84, wherein a pivot means is provided for pivotally connecting the first end of said further lever means to said control rod member.

86. A control mechanism according to claim 85, wherein said movable governor member includes a sliding means operatively connected to said motion connection means, said motion connecting means includes a pivot lever means operatively connected to said sliding means and a coupling lever means for coupling one end of said pivot lever means with said cam means.

* * * * *